US010775090B2

(12) United States Patent
Temizkan et al.

(10) Patent No.: US 10,775,090 B2
(45) **Date of Patent: *Sep. 15, 2020**

(54) HOUSEHOLD COOLING APPLIANCE COMPRISING A WEIGHT DETECTION UNIT FOR DETERMINING THE WEIGHT OF A CONTAINER OF AN ICE MAKER UNIT

(71) Applicant: BSH HAUSGERAETE GMBH, Munich (DE)

(72) Inventors: Senol Temizkan, Aalen (DE); Mathias Sigl, Herbrechtingen (DE); Klaus Pfeiffer, Heidenheim (DE)

(73) Assignee: BSH Hausgeraete GmbH, Munich (DE)

( * ) Notice: Subject to any disclaimer, the term of this patent is extended or adjusted under 35 U.S.C. 154(b) by 272 days.

This patent is subject to a terminal disclaimer.

(21) Appl. No.: 15/646,318

(22) Filed: Jul. 11, 2017

(65) Prior Publication Data

US 2019/0017736 A1 Jan. 17, 2019

(51) Int. Cl.

| | |
|---|---|
| ***F25C 1/04*** | (2018.01) |
| ***F25C 5/187*** | (2018.01) |
| ***F25D 29/00*** | (2006.01) |
| ***F25C 5/20*** | (2018.01) |

(52) U.S. Cl.

CPC ..... *F25C 5/187* (2013.01); *F25C 1/04* (2013.01); *F25C 5/22* (2018.01); *F25D 29/00* (2013.01); *F25C 2600/04* (2013.01); *F25D 2323/021* (2013.01); *F25D 2700/00* (2013.01)

(58) Field of Classification Search

CPC ..... F25C 2600/04; F25C 5/187; F25C 5/22; F25D 2700/00

See application file for complete search history.

(56) References Cited

U.S. PATENT DOCUMENTS

| | | | | |
|---|---|---|---|---|
| 4,958,517 | A * | 9/1990 | Maron | E21B 47/0006 73/152.48 |
| 6,619,574 | B1 * | 9/2003 | Fontanille | B02C 17/1805 241/171 |
| 7,423,511 | B2 * | 9/2008 | Nakasone | G01L 1/2231 29/595 |
| 8,850,779 | B2 * | 10/2014 | Pandurangan | B65B 25/001 53/384.1 |
| 2001/0037960 | A1 * | 11/2001 | Ratesic | G01G 13/22 209/592 |
| 2004/0261900 | A1 * | 12/2004 | Ensor | B65B 37/20 141/314 |
| 2007/0119195 | A1 * | 5/2007 | Meredith | F25C 5/187 62/137 |
| 2012/0125018 | A1 * | 5/2012 | Shaha | F25C 5/182 62/66 |
| 2015/0059394 | A1 * | 3/2015 | Gomes | F25C 5/06 62/340 |
| 2016/0290710 | A1 * | 10/2016 | Lee | B01F 3/04808 |
| 2018/0245833 | A1 * | 8/2018 | Brewer | F25C 5/187 |

* cited by examiner

*Primary Examiner* — Filip Zec

(74) *Attorney, Agent, or Firm* — Laurence A. Greenberg; Werner H. Stemer; Ralph E. Locher

(57) ABSTRACT

A household cooling appliance includes an ice maker unit for making ice, wherein the ice maker unit has a container, in which the ice is stored, a weight detection unit for determining the weight of the container, and an evaluation unit, which is configured for determining a filling level of the container with ice depending on the weight.

9 Claims, 3 Drawing Sheets

HOUSEHOLD COOLING APPLIANCE COMPRISING A WEIGHT DETECTION UNIT FOR DETERMINING THE WEIGHT OF A CONTAINER OF AN ICE MAKER UNIT

TECHNICAL FIELD

The invention relates to a household cooling appliance comprising an ice maker unit for making ice, wherein the ice maker unit comprises an ice maker unit, in which the ice is stored.

BACKGROUND OF THE INVENTION

Household cooling devices for storing and preserving food, which comprise an ice maker unit, are known. For determining a filling level of ice in a container of the ice maker unit complex methods are known, in which by means of optical detection this filling level is determined. Besides the complexity of such design this is also prone to errors, in particular due to the possible motions or changes in the position of the container, which can also be the result of the filling level.

SUMMARY OF THE INVENTION

It is the task of the present invention to provide a household cooling appliance, in which the capturing of quantity of ice in the container of the ice maker unit can be effected precisely and as simply as possible.

This task is solved by a household cooling appliance as claimed.

One aspect of the invention relates to a household cooling appliance comprising an ice maker unit for making ice. The ice maker unit comprises a container, in which the ice is storable. The household cooling appliance comprises a weight detection unit for capturing the weight of the container. The household cooling appliance comprises an evaluation unit which is configured for determining a filling level of the container with ice depending on the weight.

Further features of the invention derive from the claims, the figures, and the description of the figures. The features and feature combinations previously named in the description as well as the features and feature combinations named in the following in the description of the figures and/or shown in the figures alone can be used only in the respective indicated combination, but also in other combinations, without leaving the scope of the invention. Thus, also embodiments of the invention are to be considered as comprised and disclosed, which are not explicitly shown and explained in the figures, however derive through separated feature combinations from the explained embodiments and can be generated therefrom. Also embodiments and feature combinations are to be considered as disclosed, which thus do not have all features of an originally formulated independent claim. Moreover, embodiments and feature combinations are to be considered as disclosed, in particular by the embodiments set out in the above, which go beyond the feature combinations set out in the back-references of the claims or deviate therefrom.

BRIEF DESCRIPTION OF THE DRAWINGS

Embodiments of the invention are explained in more detail in the following on the basis of schematic drawings. These show in.

DETAILED DESCRIPTION OF PREFERRED EMBODIMENTS

In the figures identical and functionally identical elements are equipped with the same reference signs.

Wth indications "top", "bottom", "front", "rear", "horizontal", "vertical", "depth direction", "width direction", "height direction" etc. the positions and orientations given for intended use and intended arrangement of the ice maker bowl or the appliance are indicated.

Figure 1:
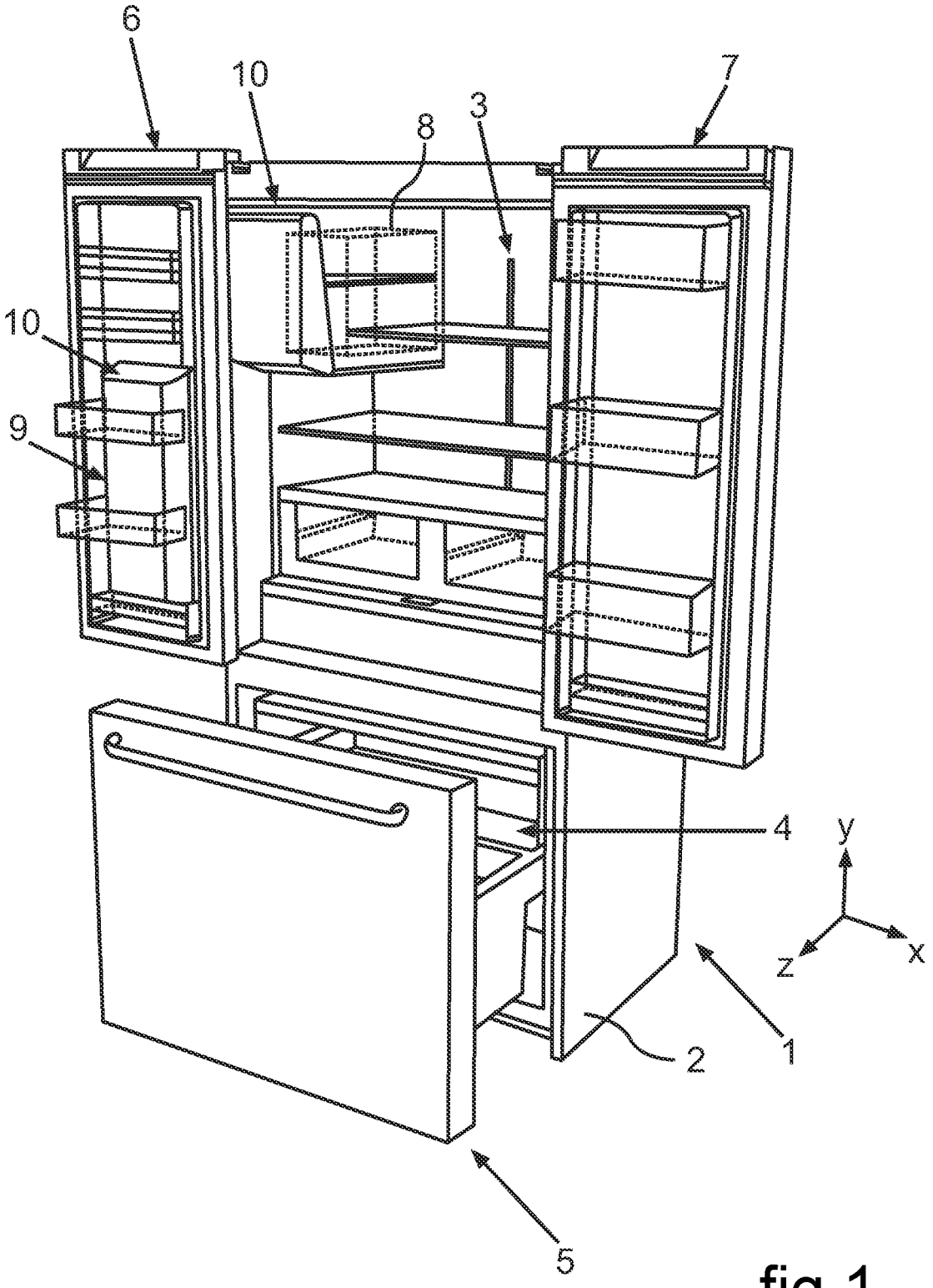
FIG. 1 a schematic view of an embodiment of a household cooling appliance.

In FIG. 1 in a perspective view an embodiment of a household cooling appliance 1 is shown. The household cooling appliance 1 is configured for storing and preserving food. In the shown embodiment the household cooling appliance 1 is a fridge/freezer combination device. However, it may also be only a cooling device.

The shown household cooling appliance 1 comprises an outer housing 2. In the outer housing 2 a first receiving space for food is configured, which here is a cooling compartment 3. The household cooling appliance 1 moreover comprises a second receiving space for food that is separate from the first receiving space and here is a freezer compartment 4. As can be seen, in the embodiment shown here the cooling compartment 3 and the freezer compartment 4 are arranged one above the other in the height direction (y direction) of the household cooling appliance 1. The freezer compartment 4, which is arranged further down, is closable by a door 5. The door 5 in the shown embodiment is a front wall of a drawer, which can be shifted linearly in the depth direction (z direction) of the household cooling appliance 1. The cooling compartment 3 is closable on the front side by two separate doors 6 and 7, which are shown in FIG. 1 in the opened state. The two separate doors 6 and 7 are pivotable about vertically orientated pivot axes and are arranged on the outer housing 2. The two doors 6 and 7 are arranged next to each other in the depth direction (x direction) and extend in the closed state in a front side plane. In particular also the door 5 in the closed state extends in this plane, in which also the two doors 6 and 7 extend in the closed state.

The household cooling appliance 1 moreover comprises a dispenser unit 10, which is configured for dispensing ice form elements or crushed ice. The dispenser unit moreover can optionally be configured for dispensing a beverage.

The dispenser unit 10 comprises an ice maker unit 8. The ice maker unit 8 in the shown embodiment is arranged internally situated in the cooling compartment 3. This means that whilst the ice maker unit 8 is configured and arranged to be thermally insulated against the cooling compartment 3, however only accessible and reachable via the feeding aperture of the cooling compartment 3. Thus, the ice maker unit 8 can be made accessible only when at least the door 6 is opened.

The dispenser unit 10 in addition to the ice maker unit 8 also has an output unit 9. The output unit 9 here is for instance configured to be integrated in the door 6. On an outer side of the door 6 facing away from the cooling compartment 3, which then is also a front side, a niche is formed, into which a receiving container can be placed and into which then via the output unit 9 the ice form elements or the crushed ice can be output.

The ice maker unit 8 and the output unit 9 are integral part of the named dispenser unit 10.

The ice maker unit 8 comprises an ice tray, which represents an ice form element vessel and which is not shown in FIG. 1. Into cavities of this ice form element vessel water can be put, from which then the ice form elements can be made. In addition to this ice form element vessel the ice maker unit 8 comprises a container 11 (FIG. 2), which is separate from this ice form element vessel. This container 11 is preferably arranged below the ice form element vessel so that by removing of ice form elements from the ice form element vessel these can then arrive in the container 11. It is arranged in the interior of the housing of the ice maker unit 8 shown in FIG. 1. Ice form elements made by freezing liquid in an ice form element vessel of the ice maker unit 8 then upon being taken out fall out of the ice form element vessel into the container 11 and are stored there. In the embodiment in FIG. 2, in which sub-components of the ice maker unit 8 are shown, this ice maker unit 8 is configured to comprise weight detection unit 12. This weight detection unit 12 can very generally be configured to comprise at least one strain gauge.

Figure 2:
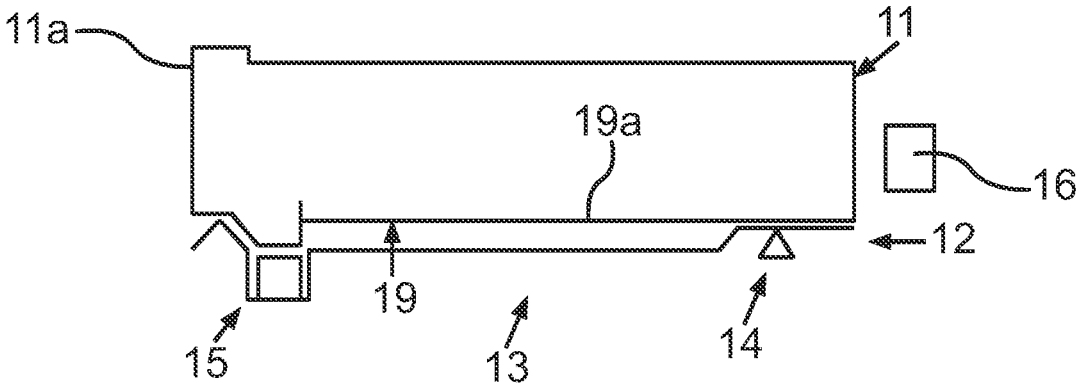
FIG. 2 a schematic view of sub-components of an ice maker unit of the household cooling appliance.

In the embodiment according to FIG. 2 the weight detection unit 12 comprises a rotation bearing 13. In the embodiment shown here below the container 11 this rotation bearing 13 is configured. The rotation bearing 13 here comprises several bearing places, in particular two bearing places 14 and 15. Equally as well two bearing places 14, 15 may be envisaged. For instance also three or four such bearing places may be envisaged. The rotation bearing 13 is configured in such a way that a bearing place, here the bearing storage place 14, is fixed. Here the second bearing place 15 is movably mounted.

By the weight of the ice, which arrives in the container 11, a pivot movement of one end 11*a* downwards is made, in particular due to the design of the rotation bearing 13. Thereby the force effect upon the rotation bearing 13 through the container 11 with the inserted ice is created individually and thereby due to the stationary bearing place 14 and the movable bearing place 15 specific force effects are effected, which are determined. In particular here determining by means of specific sensors can be envisaged so that the weight of the container with the ice contained therein can be effected very precisely. In this embodiment, too, such a sensor could be at least one strain gauge. This can in particular be changed by the rotation of the container 11, in order to then be able to determine therefrom the weight.

The household cooling compartment 1 moreover may also comprise an evaluation unit 16, which is configured for determining a filling state of the container 11 with ice depending on the detected weight. Since in particular the weight of the empty container 11 is known, the weight of the ice alone without the container 11 can be determined for instance by simple subtraction of the weight values. Depending thereon and with regard to the known size of the ice form elements, as they are output from the ice form element vessel, then moreover in particular with the known value of the volume of the container 11 the filling state can be assumed.

By such design thus very simply and still very precisely the determining of the filling state can be facilitated, whereby the individual filling quantity can be determined very precisely. On the other hand an overfilling of the container 11 can safely be avoided.

In the embodiment according to FIG. 2 it is preferably envisaged that the fixed bearing or the stationary bearing place 14 are arranged in a rear third of the length of the container 11. In particular the at least one movable bearing or the movable bearing place 15 is arranged in a front third of the length of the container 11.

Figure 3:
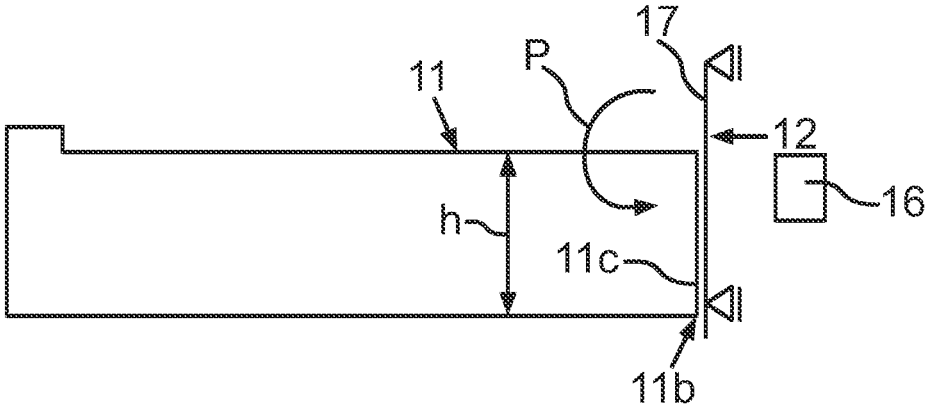
FIG. 3 a schematic view of a further embodiment of sub-components of an ice maker unit of the household cooling appliance.

In FIG. 3 a further embodiment of sub-components of the ice maker unit 8 is shown. In this embodiment the weight detection unit 12 comprises at least one strain gauge 17. The strain gauge 17 here is coupled to a further end 11*b* of the container 11, which here in particular is a rear end. The strain gauge 17 here is vertically orientated and extends in particular across at least the entire height h of this rear end 11*b* of the container 11, in particular a side wall 11*c*, which here is a rear wall. By a pivot movement according to the arrow P, which occurs due to the weight force of the container 11 in particular also when during filling it with ice, by means of the then expanding strain gauge 17 the weight of the container 11 with the ice can be precisely determined. Here, too, then via the evaluation unit 16 the determining of the weight of the ice alone can be effected and thereby then the filling state of the container 11 can be assumed.

Also several such strain gauges 17 can be configured, in particular next to each other. The strain gauge 17, however, can also be arranged at a different place, for instance in a bottom area of the container 11.

Figure 4:
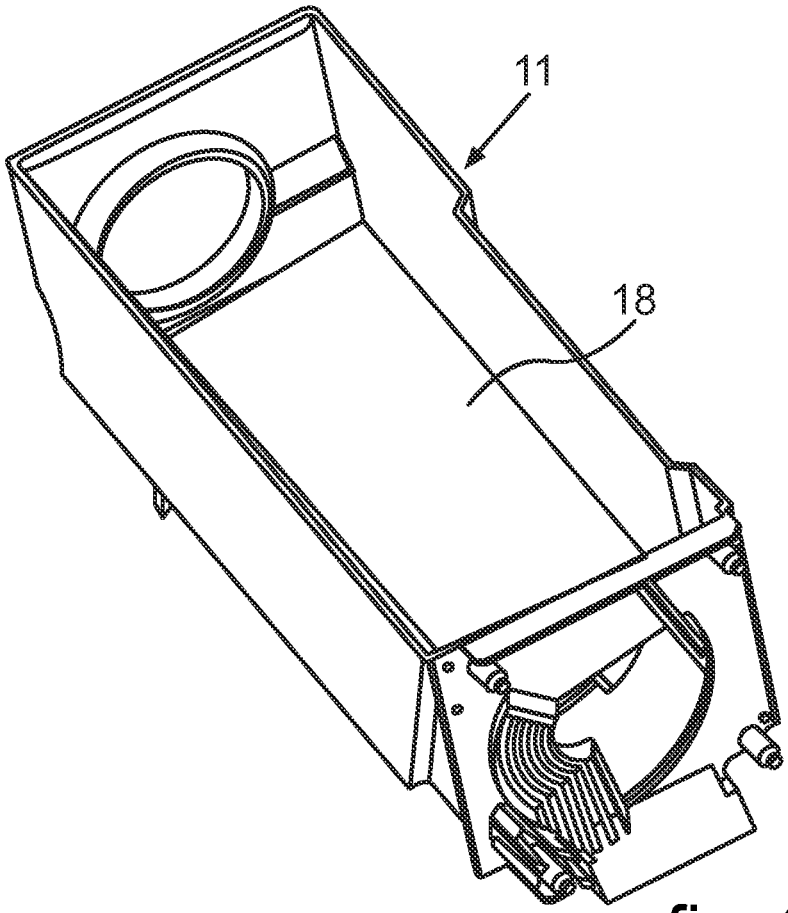
FIG. 4 a perspective view of components of a further embodiment of an ice maker unit of the household cooling appliance.

In FIG. 4 in a further embodiment a representation of sub-components of the ice maker unit 8 is shown. In this embodiment the container 11 in the interior comprises a piezo foil 18, which is integral part of the weight detection unit 12. By such a piezo foil 18 due to the effect of the ice form elements, which in particular rest directly on the piezo foil 18, the weight can be determined directly. The piezo foil 18 here is arranged on a bottom, in particular on an inner side 19*a* (FIG. 2) of the bottom 19. It may in particular be spread across the entire surface.

Figure 5:
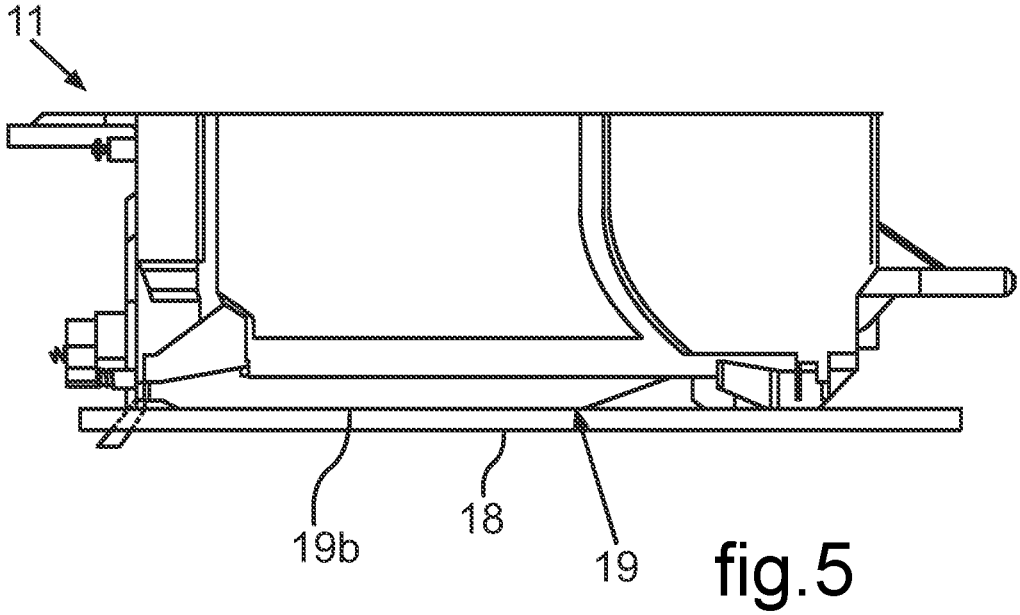
FIG. 5 a lateral view of the components according to FIG. 4 in an embodiment that is, however, different therefrom.

In FIG. 5 a further embodiment is shown, wherein here in the lateral view the container 11 is represented. In this embodiment the piezo foil 18 is arranged outside the container 11, in particular on a bottom side 19*b* of the bottom 19.

Generally, the evaluation unit is configured for determining the weight of the ice in the container. A further aspect envisages that the weight detection unit comprises at least one strain gauge. The strain gauge can be orientated vertically or orientated horizontally.

One further aspect of the invention relates to a design, in which the weight detection unit is component of a rotation bearing, wherein the rotation bearing is integral part of the household cooling appliance. Wth the rotation bearing the container is mounted rotatably. In particular by a triggering of the weight detection unit in a rotation movement of the container by means of the rotation bearing the weight of the container can be determined. In an advantageous embodiment the rotation bearing comprises at least one fixed bearing and at least one movable bearing.

In an alternative embodiment the weight detection unit comprises at least one piezo foil. This is arranged in particular on a bottom of the container. It can be arranged on the outer side of the bottom or on an inner side of the bottom. In particular the piezo foil is configured to cover the entire surface on the respective side of the container.

LIST OF REFERENCES

1 household cooling appliance
2 outer housing

3 cooling compartment
4 freezer compartment
5 door
6 door
7 door
8 ice maker unit
9 output unit
10 dispenser unit
11 container
11*a* end
11*b* end
11*c* side wall
12 weight detection unit
13 rotation bearing
14 bearing place
15 bearing place
16 evaluation unit
17 strain gauge
18 piezo foil
19 bottom
19*a* inner side
19*b* bottom side
P arrow
h height

The invention claimed is:

1. A household cooling appliance comprising:

an ice maker unit for making ice, said ice maker unit including a container in which the ice is stored and the container having side walls including a rear wall, a weight detection unit for determining the weight of the container, said weight detection unit comprising at least one strain gauge to measure weight force of said container, said strain gauge being vertically orientated and disposed to measure a deflection at said rear wall due to the weight of the container, and an evaluation unit, which is configured for determining a filling level of the container with ice depending on the weight.

2. The household cooling appliance according to claim 1, wherein the evaluation unit is configured for determining the weight of the ice in the container.

3. The household cooling appliance according to claim 1, wherein the strain gauge is in contact with the rear wall of the container and extends vertically across an entire height of the rear wall.

4. A household cooling appliance comprising:

an ice maker unit for making ice, wherein the ice maker unit includes a container, in which the ice is stored, a weight detection unit for determining the weight of the container, wherein the weight detection unit is part of a rotation bearing, with which the container is mounted rotatably;

an evaluation unit, which is configured for determining a filling level of the container with ice depending on the weight; and wherein the rotation bearing comprises at least one fixed bearing and at least one movable bearing, and comprises a strain gauge arranged between said fixed bearing and said movable bearing.

5. The household cooling appliance according to claim 4, wherein the weight is determinable by triggering the weight detection unit upon a rotation movement of the container.

6. The household cooling appliance according to claim 1, wherein the weight detection unit comprises a piezo foil.

7. The household cooling appliance according to claim 6, wherein the piezo foil is arranged on a bottom of the container.

8. The household cooling appliance according to claim 7, wherein the piezo foil is arranged on an inner side of the bottom.

9. The household cooling appliance according to claim 7, wherein the piezo foil is arranged on an outer side of the bottom.

* * * * *